US011383342B2

(12) United States Patent
Junker

(10) Patent No.: US 11,383,342 B2
(45) Date of Patent: Jul. 12, 2022

(54) METHOD AND CYLINDRICAL GRINDING MACHINE FOR CENTERLESS CYLINDRICAL GRINDING

(71) Applicant: ERWIN JUNKER GRINDING TECHNOLOGY A.S., Melnik (CZ)

(72) Inventor: Erwin Junker, Buehl/Baden (DE)

(73) Assignee: ERWIN JUNKER GRINDING TECHNOLOGY A.S., Melnik (CZ)

( * ) Notice: Subject to any disclaimer, the term of this patent is extended or adjusted under 35 U.S.C. 154(b) by 0 days.

(21) Appl. No.: 14/648,860

(22) PCT Filed: Dec. 5, 2013

(86) PCT No.: PCT/EP2013/075656
§ 371 (c)(1),
(2) Date: Jun. 1, 2015

(87) PCT Pub. No.: WO2014/090678
PCT Pub. Date: Jun. 19, 2014

(65) Prior Publication Data

US 2015/0298275 A1 Oct. 22, 2015

(30) Foreign Application Priority Data

Dec. 14, 2012 (DE) ..... 10 2012 223 276.1

(51) Int. Cl.
*B24B 49/00* (2012.01)
*B24B 49/16* (2006.01)
*B24B 5/307* (2006.01)

(52) U.S. Cl.
CPC ..... *B24B 5/307* (2013.01); *B24B 49/006* (2013.01); *B24B 49/16* (2013.01)

(58) Field of Classification Search
CPC ..... B24B 49/006; B24B 49/16; B24B 5/307; B24B 49/08; B24B 5/04; B24B 5/18;
(Continued)

(56) References Cited

U.S. PATENT DOCUMENTS 712,815 A * 11/1902 Landis ..... B24B 41/065 144/30
1,364,006 A * 12/1920 Swanson ..... B24B 5/307 451/407

(Continued)

FOREIGN PATENT DOCUMENTS

DE 55918 9/1890
DE 341606 C 10/1921

(Continued)

OTHER PUBLICATIONS

International Search Report for application No. PCT/EP2013/075656, dated Feb. 17, 2014.

(Continued)

*Primary Examiner* — Joseph J Hail
*Assistant Examiner* — Arman Milanian
(74) *Attorney, Agent, or Firm* — Marshall, Gerstein & Borun LLP

(57) ABSTRACT

A method and a cylindrical grinding machine for centerless cylindrical grinding of a workpiece. The workpiece is supported on a first contact surface and a second contact surface arranged at an angle relative to one another. A grinding disk is applied to the workpiece with an application force, whereby the workpiece is in turn pressed against the first and second contact surfaces, which cause braking of the workpiece (which is rotationally driven solely by the grinding disk). The braking reduces the rotational speed of the workpiece such that the grinding disk produces grinding in addition to rotationally driving the workpiece. The rotational speed of the workpiece can be precisely set by means of an additional brake that applies an adjustable braking force to the workpiece.

23 Claims, 3 Drawing Sheets

(58) Field of Classification Search
CPC ..... B24B 5/22; B24B 41/062; B24B 41/067; B24B 41/065
USPC ..... 451/10, 11, 242, 243, 246, 49, 5, 51, 8
See application file for complete search history.

(56) References Cited

U.S. PATENT DOCUMENTS

| | | | | | |
|---|---|---|---|---|---|
| 1,449,507 | A * | 3/1923 | Fors | B24B 41/065 | 451/408 |
| 1,577,353 | A * | 3/1926 | Einstein | B24B 41/065 | 451/408 |
| 1,663,991 | A * | 3/1928 | Nenninger | B24B 5/307 | 451/242 |
| 1,709,671 | A * | 4/1929 | Kearns | B24B 41/065 | 451/246 |
| RE17,311 | E * | 5/1929 | Swanson | B24B 5/307 | 15/88 |
| RE117,311 | * | 5/1929 | Swanson | B24B 5/00 | 451/406 |
| 2,099,161 | A * | 11/1937 | De Leeuw | B24B 41/065 | 451/246 |
| 2,102,518 | A * | 12/1937 | Johnson | B24B 49/04 | 451/1 |
| 2,261,903 | A * | 11/1941 | La Fleur | B24B 41/065 | 451/408 |
| 2,286,620 | A * | 6/1942 | Hollengreen | B24B 41/065 | 451/408 |
| 2,638,719 | A * | 5/1953 | Balsiger | B24B 5/42 | 451/249 |
| 2,743,555 | A * | 5/1956 | Irvine | B24B 5/307 | 451/242 |
| 3,330,074 | A * | 7/1967 | Stuckey | B24B 41/065 | 451/246 |
| 3,391,500 | A * | 7/1968 | Messier | B24B 5/35 | 451/408 |
| 3,425,168 | A * | 2/1969 | Porath | B24B 41/065 | 451/246 |
| 3,427,755 | A * | 2/1969 | Barney | B24B 41/065 | 451/1 |
| 3,854,252 | A * | 12/1974 | Lindsay | B24B 5/35 | 451/244 |
| 3,859,755 | A * | 1/1975 | Schaller | B24B 5/38 | 451/5 |
| 3,977,129 | A * | 8/1976 | Bottomley | B24B 41/065 | 451/14 |
| 4,181,077 | A * | 1/1980 | Dalton | B41C 1/045 | 101/401.1 |
| 4,276,723 | A * | 7/1981 | Fournier | B24B 41/065 | 451/408 |
| 4,324,073 | A * | 4/1982 | Belthle | B24B 47/206 | 451/28 |
| 4,507,896 | A * | 4/1985 | Smith | B24B 5/22 | 451/242 |
| 4,663,892 | A * | 5/1987 | Smith | B24B 41/065 | 451/408 |
| 5,048,235 | A * | 9/1991 | Smith | B24B 1/00 | 125/11.01 |
| 5,177,901 | A * | 1/1993 | Smith | B24B 1/00 | 125/11.01 |
| 5,285,599 | A * | 2/1994 | Lessway | B23Q 1/76 | 451/49 |
| 5,443,411 | A * | 8/1995 | Rouyer | B24B 5/37 | 451/11 |
| 6,148,248 | A * | 11/2000 | Sun | B24B 5/307 | 451/11 |
| 6,273,785 | B1 * | 8/2001 | Mulroy | B23Q 1/385 | 451/178 |
| 6,287,183 | B1 * | 9/2001 | Zhang | B24B 5/18 | 384/116 |
| 7,008,294 | B2 * | 3/2006 | Junker | B24B 41/065 | 451/246 |

FOREIGN PATENT DOCUMENTS

| | | | | |
|---|---|---|---|---|
| DE | 1009525 | B * | 5/1957 | B24B 5/35 |
| DE | 1179826 | A | 10/1964 | |
| DE | 4330800 | A1 | 2/1994 | |
| EP | 0211539 | A2 | 2/1987 | |
| JP | H09323244 | A * | 6/1996 | B24B 49/00 |
| SU | 159739 | | 11/1963 | |
| SU | 814667 | A1 | 3/1981 | |

OTHER PUBLICATIONS

Examination report for German application 10 2012 223 276.1, dated Sep. 16, 2013.
Dubbel, Taschenbuch filr den Maschinebau, 15$^{th}$ ed., 1983, p. 1003, Figs. 50g, h.

* cited by examiner

METHOD AND CYLINDRICAL GRINDING MACHINE FOR CENTERLESS CYLINDRICAL GRINDING

CROSS-REFERENCE TO RELATED APPLICATION

This is the United States national phase of International Patent Application No. PCT/EP2013/075656, filed Dec. 5, 2013, which claims the priority benefit of German Application No. 10 2012 223 276.1, filed Dec. 14, 2012. The entire contents of each of the foregoing is hereby incorporated by reference.

FIELD OF THE DISCLOSURE

The present disclosure relates to a method for centerless cylindrical grinding of workpieces having a rotationally symmetrical contour, and to a centerless cylindrical grinding machine.

BACKGROUND

In the best-known embodiment of cylindrical grinding machines for centerless cylindrical grinding, the rotationally symmetrical workpiece is located between a rotating regulating disk and a rotating grinding disk, and is additionally supported on the so-called support ruler (for example, see *Dubbel, Taschenbuch für den Maschinenbau,* 15th ed. 1983, p. 1003, FIG. 50 g, h). The workpiece is therein driven to rotate by the regulating disk, and ground by the grinding disk. The regulating disk and grinding disk are mounted onto drive units (in terms of the grinding disk, the drive unit is known as a grinding headstock or grinding spindle unit) in the usual manner, wherein the circumferential speed of the regulating disk must be lower than that of the grinding disk. The difference in the rotational speeds—so-called slippage—brings about the grinding action. The terms "grinding disk" and "regulating disk" as used in this application refer to working concepts in terms of the function thereof in the centerless cylindrical grinding, but do not imply any limitation with respect to the configuration thereof in the axial extension. These disks thus may be, for example, cylindrically continuous, stepped, or conic in shape, and may also comprise a plurality of sections of different contours. The regulating disk and the grinding disk may be composed of individual section parts in the axial direction, the individual section parts being directly adjacent to one another or separated by intervening gaps.

Those skilled in the art of tool machines have long known that with centerless cylindrical grinding of machine components in mass production in which grinding must be done at high rotational speeds of the regulating and grinding disks, the grinding results no longer meet the highest demands, nor do the dimensional accuracy, the roundness, or the surface quality. The regulating disk has been recognized as one of the possible sources of error. Depending on the quality of the configuration thereof and the mounting thereof in the associated drive unit, this may itself have a run-out error that has harmful effects on the grinding results. Added to this is the fact that the regulating disk needs to be dressed from time to time, whereby further inaccuracies can arise.

The aforementioned patent document DD 55 918 A thus proposes that in centerless cylindrical grinding of disk-shaped workpieces having very small dimensions, the regulating disk should no longer be driven to rotate. The support ruler is also omitted therein. Instead, a support device is provided, which is referred to as a "workpiece holder" and is composed of two rows of ball bearings that are mounted slightly rotatably in bearing blocks on two parallel axes. To a certain extent, the driven regulating disk and the support ruler are thereby replaced by two rows of non-driven regulating disks. The grinding disk and the two rows of ball bearings form a grinding gap in which the workpieces are located and rest on two opposing ball bearings. During grinding, the workpieces are rotated by the traction with the grinding disk, wherein the support of the workpieces on the ball bearings produces little friction against the grinding disk. The workpieces obtain the rotation required for the grinding process exclusively due to frictional entrainment by the grinding disk.

The embodiment according to DD 55 918 A does indeed have the advantage of being structurally somewhat simpler, because the motor driving of the regulating disk is eliminated. A major cause of inaccurate grinding results remains, however, or is even increased, because the support of the workpiece on the two rows of rotating bodies constitutes an unavoidable source of error. The roundness of the bearing outer rings and the accuracy of the mounting thereof onto the balls and the bearing inner rings are too low and uneven in relation to the accuracy that is required by the centerless cylindrical grinding according to the application.

Another proposal for centerless cylindrical grinding without a regulating disk is found in patent document DE 43 30 800 A1. That proposal is also based on the finding that the regulating disk that contacts the workpiece is rotatably mounted and therefore is fundamentally not free of run-out errors. The remedy should be for a single, fixed prism to be provided as a support device for the cylindrical workpieces, the prism serving as a workpiece holder, and for a circulating endless drive belt to serve as a rotational drive for the workpiece. Furthermore, a finger loaded by a spring is provided, the finger pushing the workpiece into the recess of the prism. A disadvantage in the configuration according to DE 43 30 800 A1 is that the arrangement of a drive belt again requires an increased structural complexity with an additional driving device, as compared to the ball bearings according to DD 55 918 A. Because of the required longitudinal extension of the drive belt, the grinding gap that is given by the prism is also less accessible. It is moreover impossible to exclude the concern that the flexible drive belt, which runs over rollers, will cause irregularities in the rotational movement of the workpiece, introducing rhythmic disturbances or vibrations into the grinding process, which have an adverse effect on the grinding result.

Patent document DE 341 606 A discloses a workpiece guidance on machines for grinding cylindrical or conical bodies by means of a triplet of cooperating guide rails for centerless cylindrical grinding. Two of the guide rails form a wedge space that opens to the outside from the grinding disk, the workpiece that needs to be ground being arranged in the wedge space. A back rail arranged on the opening side of the wedge space is movable in the direction of the two other rails, i.e., in the direction of the grinding disk, so that the workpiece is pressed against the two guide rails in the direction against the grinding disk under the action of a continuously acting pressure.

Patent document DE 11 79 826 A describes a device for centerless cylindrical grinding which comprises an arrangement of a grinding disk, a regulating disk, and a support rail, in a conventional manner. The support rail can be formed as a prism support that is arranged so as to be pivotable, i.e., movable about a free fulcrum. There, both the grinding disk and the regulating disk are provided with a drive. In order to avoid waviness in the surface of the workpiece needing to be ground, the free tilting of the workpiece support serves to always distribute the support points for the workpiece so as to compensate for the forward movement, caused by a wave crest, of the workpiece through the simultaneous return due to the wave troughs on the support surfaces.

The invention addresses the problem of providing a method and device of the first aforementioned type corresponding to DD 55 918 A, with which the rotationally symmetrical parts can be ground with greater dimensional and geometric accuracy, even at high operating speeds of operational mass production, the required cylindrical grinding machine nevertheless being fundamentally simple in design, and thus very cost-effective, and reliably working over longer periods of time with consistent accuracy.

The problem is solved, concerning the method, with the totality of the features of claim 1, and concerning the cylindrical grinding machine, with the totality of the features of claim 3.

GENERAL DESCRIPTION

The advantage of the disclosure, as compared to DD 55 918 A, is that beyond the rotation for rotating the driven grinding disk, no other rotation-based drive or support parts based are required. The two non-rotating contact surfaces, which are formed so as to be flat in the associated cylindrical grinding machine, impart in any event a more accurate support than the ball bearings in the prior art. In comparison to DE 43 30 800 A1, the invention has an advantage in that a separate drive device for the rotation of the workpiece is not necessary. According to the disclosure method, a single rotational drive for the grinding disk is needed, which at the same time also moves the workpiece to rotate. Harmful effects from the additional drive device in the form of a circulating drive belt can be avoided in any event.

In an advantageous embodiment the ratio of the rotational speeds of the grinding disk and the workpiece can be continuously monitored and regulated to a defined optimal ratio. The application force of the grinding disk and the braking force that is exerted by the support device can be adjusted so as to result in a defined ratio of the rotational speeds of the workpiece and the grinding disk, which leads to optimum grinding results.

With respect to the centerless cylindrical grinding machine, the problem addressed by the invention is solved in that the support device comprises at least one first flat contact surface and one second flat contact surface, which both are operationally immobile in the circumferential direction of the workpiece, extend at a distance from one another along the workpiece, and encompass the workpiece under sliding contact. Flat contact surfaces, which correspond to the known support ruler, are a proven means of supporting the rotating workpiece. The workpiece is held by these flat contact surfaces with the greatest possibility accuracy in the predetermined position thereof that is optimal for the grinding process. All run-out errors that result from a rotating support are thereby eliminated. The support surfaces are optimally set to the circumferential direction of the workpiece and the diameter thereof, this adjustment being operationally inalterable in this respect.

However, different settings of the first flat contact surface and the second flat contact surface need to be made in accordance with the diameter of the workpiece and the desired grinding process. An appropriate setting can be easily made before the grinding process by adjusting or replacing the contact surfaces. During the grinding process itself, however, the first flat contact surface and the second flat contact surface remain for the most part totally operationally immobile.

In certain grinding processes, e.g., plunge grinding, the contact surfaces must sometimes even be adjusted during the grinding process, because they need to be constantly adapted to the decreasing diameter of the workpiece 1 at the grinding point. According to another advantageous embodiment, the first contact surface and the second contact surface may be configured so as to be operationally controllably movable.

Another advantageous embodiment may be relevant on its own or in conjunction with the other advantageous embodiments. It relates to the fact that the first contact surface is located on a support plate that is found beneath the workpiece, the support plate being formed according to the manner of the conventional support ruler. The second contact surface may be located on a particular support rail that is arranged opposite to the grinding disk. The support plate and support rail enable stable mounting of the two contact surfaces, so that the required grinding accuracy remains reliable for a long time. In this manner, the application force exerted on the grinding disk pushes the workpiece in an optimal contact against the first and second support surface.

The two contact surfaces constitute stable and consistent contact surfaces which also exert a substantially constant braking force on the rotation of the workpiece in conjunction with a constant application force of the grinding disk. It is, however, also possible to adjust this braking force precisely to a certain value that is selected for a certain grinding process. To this end, a brake comprising a braking body is arranged on the support device, the braking body acting on the workpiece via an adjustment device with an adjustable braking force.

According to another embodiment, the brake may be designed so that the braking body forms another support body having a third contact surface.

With regard to the arrangement of this third contact surface, this faces the first contact surface and acts on the workpiece from above.

Another embodiment of the cylindrical grinding machine according to the disclosure is relevant on its own, but may also be performed in conjunction with the other previously identified embodiments. Then, the first contact surface and the second contact surface are combined into a shared support body that forms a prism opposing the grinding disk and encompasses the workpiece. Such a prism may be formed so as to be solid and very stable, whereby a more secure, low-wear, and reliable support of the workpiece at the desired position is ensured. Such a solid prism may also be mounted as a whole and, where appropriate, change sides from a working position thereof to a maintenance position, if it is necessary. The cross-section of the prism then may have the form of an angle or the form of a trapezoid. What is critical, in any case, is that oblique contact surfaces that encompass the workpiece are formed.

Finally, it may be provided that the cylindrical grinding machine has a device for measuring the rotational speed, through which the workpiece rotational speed is constantly monitored. In an assessment and regulation arrangement, the optimal balance between the grinding disk rotational speed, the application force of the grinding disk, and the braking force of the braking body can thus be constantly maintained. In this manner, not only is the support device of the cylindrical grinding machine according to the invention furnished for an optimal grinding result, but also certain optimal operating conditions can be sustained even with greater constancy in the desired manner.

BRIEF DESCRIPTION OF THE DRAWINGS

The invention shall be made more readily apparent through the following embodiments depicted in the accompanying drawings. The drawings illustrate the following.

DETAILED DESCRIPTION

Figure 1:
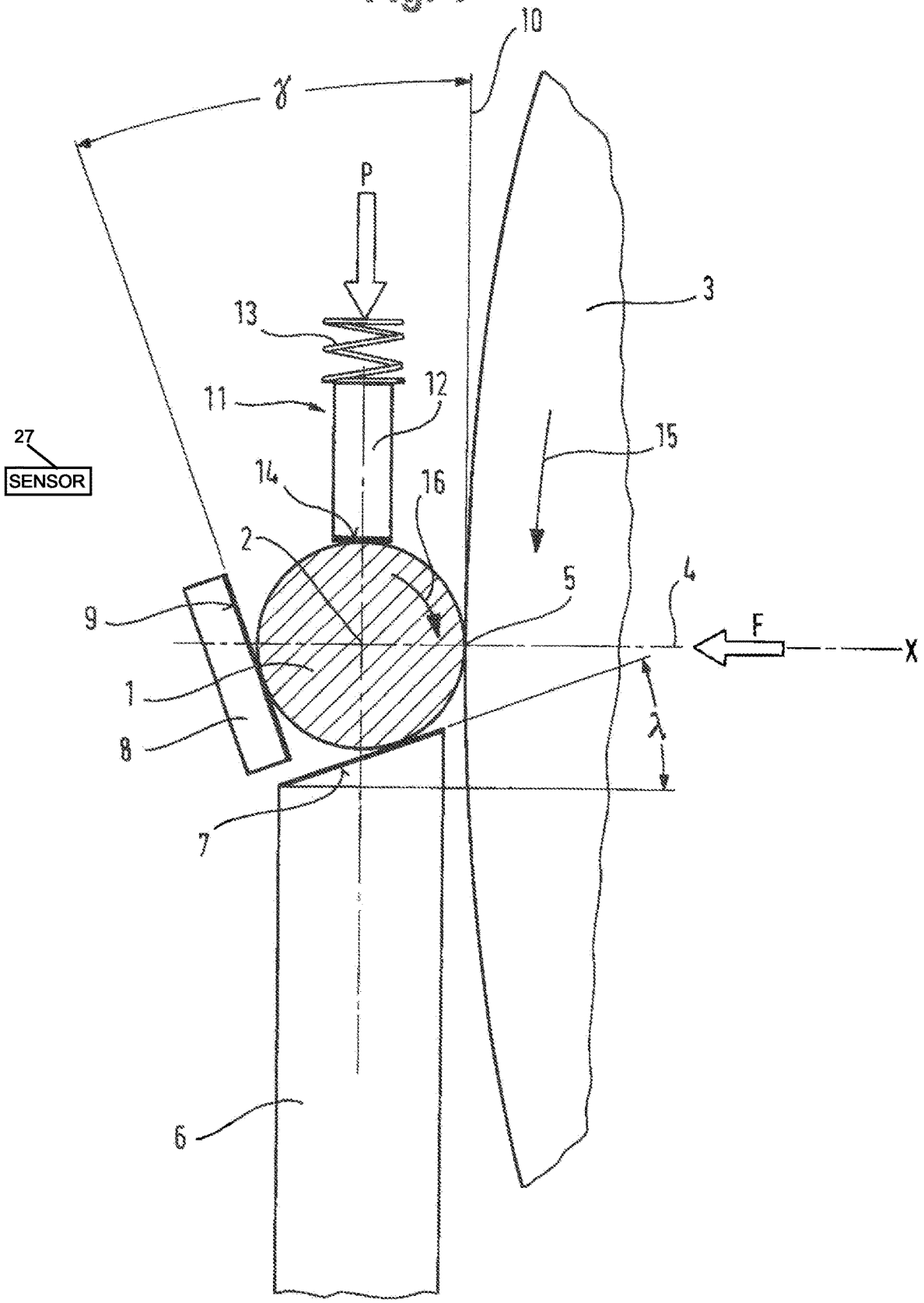
FIG. 1 is a schematic diagram of the most important component parts in a cylindrical grinding machine for centerless cylindrical grinding with which the method according to the invention is embodied.

FIG. 1 depicts a section of a cylindrical grinding machine for centerless cylindrical grinding, in cross-section. The cylindrical workpiece 1 has a longitudinal axis 2 and, during operation, comes into contact with the rotating grinding disk 3, the rotational axis thereof lying outside the surface of the drawing. In the selected cross-section according to FIG. 1, the horizontal connecting line 4 runs parallel to the horizontally positioned longitudinal axis 2 of the workpiece and to the rotational axis (not shown) of the grinding disk 3. This results in the contact point 5, at which the grinding disk 3 and the workpiece 1 come into contact with one another at the periphery thereof. It shall be remembered, however, that in certain grinding processes, the rotational axis of the grinding disk 3 can be inclined at a small angle of about 3° to 5° from the horizontal, e.g., in through-feed grinding of cylindrical workpieces 1, which thereby receive their forward thrust in the longitudinal direction. The material of the grinding disk 3 may be corundum or CBN.

Below the grinding disk 3 is a support plate 6, which is formed as a common support ruler. The upwardly facing flat surface thereof is the first contact surface 7 of the support device configured according to the invention. The first contact surface 7 is, as usual, inclined downward at an angle λ, originating from the side thereof facing the grinding disk 3. To adapt to the respective grinding process needing to be addressed, the first contact surface 7 can be adjusted in height. In addition to the setting "below center" depicted in FIG. 1, possible settings include "center" and "over center." The center is given by the connecting line 4. It is additionally possible to grind at difference angles of inclination λ. For this purpose, the first contact surface 7 is adjusted or the entire support plate 6 is replaced. In most instances, it suffices to perform the altered setting before the cylindrical grinding machine is put into operation; during the grinding, the setting of the first contact surface 7 thus remains operationally unaltered, and it is totally "operationally immobile." In other cases, the support plate 6 must be adjusted during grinding; for example, this is the case sometimes during plunge grinding if the first contact surface 7 then must be continuously adapted to the decreasing diameter of the workpiece 1. Then, the first contact surface 7 is configured so as to be "operationally controllably movable."

A support rail 8 on which the second flat contact surface 9 is located is arranged opposite the grinding disk 3 with a certain angular offset. The angular offset corresponds approximately to the angle A. In FIG. 1, the second flat contact surface 9 forms an angle γ with a shared tangent 10 that is placed in the contact point 5 to the workpiece 1 and the grinding disk 3. Other angular positions are also possible. Moreover, the same applies for the support rail 8 and the second contact surface 9 as for the support plate 6 with the first contact surface 7. Both contact surface 7 and 9 can thus be provided so as to be "operationally immobile" or "operationally controllably movable," wherein it is possible to adjust both contact surfaces together or an individual one—be it the first contact surface 7 or the second contact surface 9, independently of one another. The contact surfaces 7 and 9 may be composed of polycrystalline diamond (PCD) or hard metal; the upper surfaces of the support plate 7 and the support rail 8 are then coated accordingly.

Figure 1A:
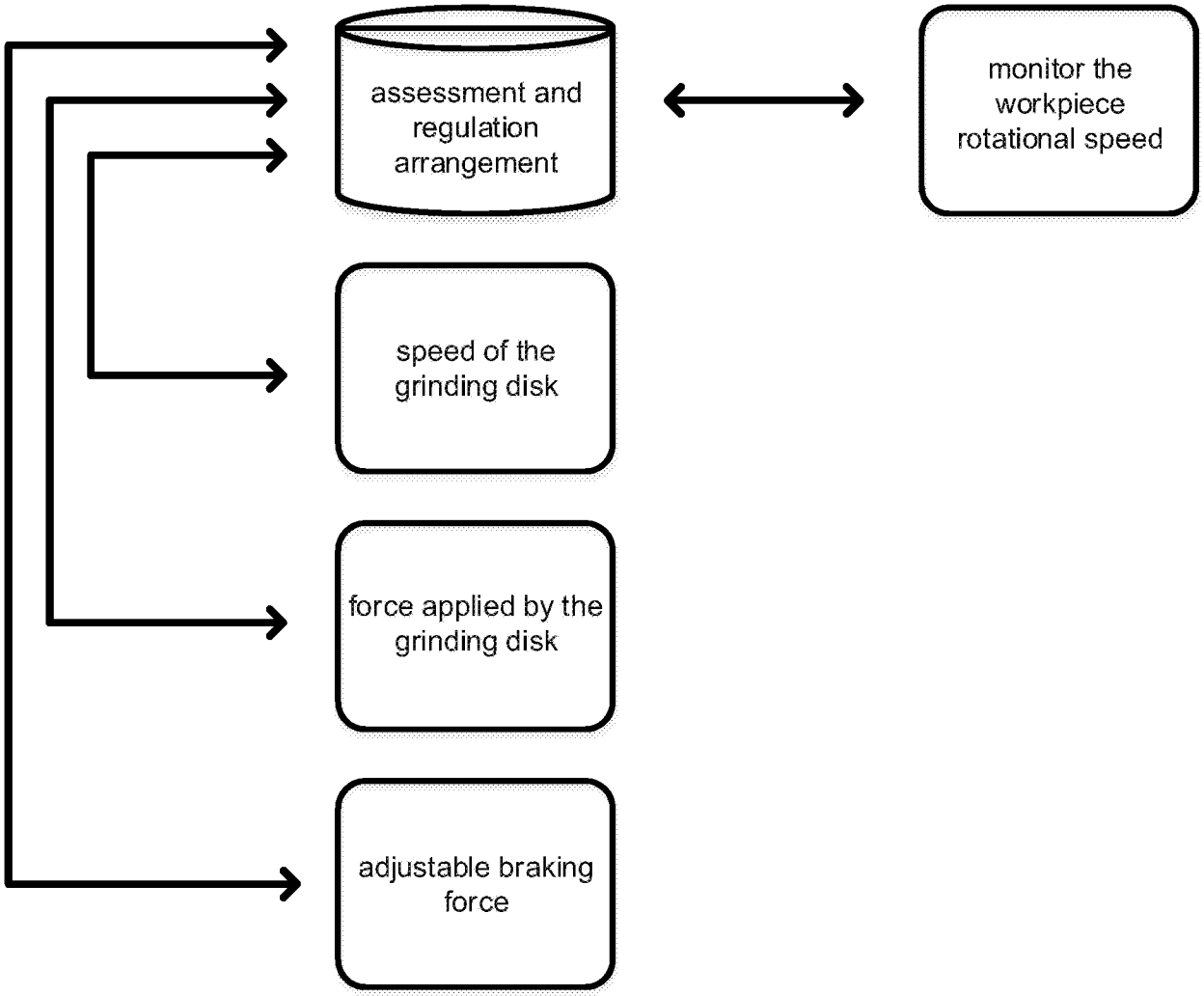
FIG. 1*a* illustrates an assessment and regulation arrangement.

FIG. 1 further illustrates a schematic representation of a brake 11. Herein, a braking body 12 is acted upon with a braking force P by an actuator (not shown) via an intermediate spring system 13. The braking body 12 is located with a third contact surface 14 against the peripheral surface of the workpiece 1. The braking force P is applied via the intermediate spring system 13 in such a manner that during the grinding operation, the workpiece 1 is braked to the correct extent. The grinding disk 3 must, namely, drive the workpiece 1 to rotate on the one hand, but on the other hand also exert a grinding action, by when the rotational speed of the workpiece 1 is lower than the rotational speed of the grinding disk 3. For this purpose, the rotational speed of the workpiece 1 is constantly monitored, for which purpose many possibilities are available, such as sensors 27 or structure-borne sound sensors. According to the measured rotational speed, an assessment and regulation arrangement continually produces the optimum balance between the grinding disk rotational speed, the application force of the grinding disk 3, and the braking force 3, whereby the optimum rotational speed of the workpiece 1 finally is achieved, as shown in FIG. 1*a*.

During operation of the cylindrical grinding machine depicted in partial cross-section in FIG. 1, the workpiece 1 abuts against the first contact surface 7 and the second contact surface 9. The rotating grinding disk 3, when applied against the workpiece 1, exerts an application force F in the X-direction onto the workpiece 1. At the shared contact point 5 of the workpiece 1 and the grinding disk 3, the grinding disk 3 acts as a "friction drive" and causes the workpiece 1 to rotate in accompaniment. The direction of movement 15 on the surface of the grinding disk 1 and the direction of movement 16 on the surface of the workpiece 1 run concordantly at the contact point 5. The workpiece 1 is thereby pressed against with a certain pressure force on the first contact surface 7 and the second contact surface 9. The workpiece 1 can then still rotate relatively easily on the contact surfaces 7 and 9, but is decelerated somewhat and therefore has a reduced rotational speed. If, in addition, the brake 11 is operated, then the rotational speed of the workpiece 1 is very significantly reduced. At the shared contact point 5 of the workpiece 1 and the grinding disk 3, a significant slippage results in the entrainment of the workpiece 1 by the grinding disk 3. The workpiece 1 is thus entrained in rotation by the grinding disk 3 only to a reduced extent, the result of which is the grinding action that the grinding disk 3 now exerts on the workpiece 1. The correct ratio between the input power and the grinding action is set and maintained by measuring the workpiece rotational speed and the already-mentioned assessment and regulation arrangement. The brake 11 makes it possible to adjust the braking action on the workpiece 1 much more accurately than if the braking were being performed solely through the first contact surface 7 and the second contact surface 9.

Figure 2:
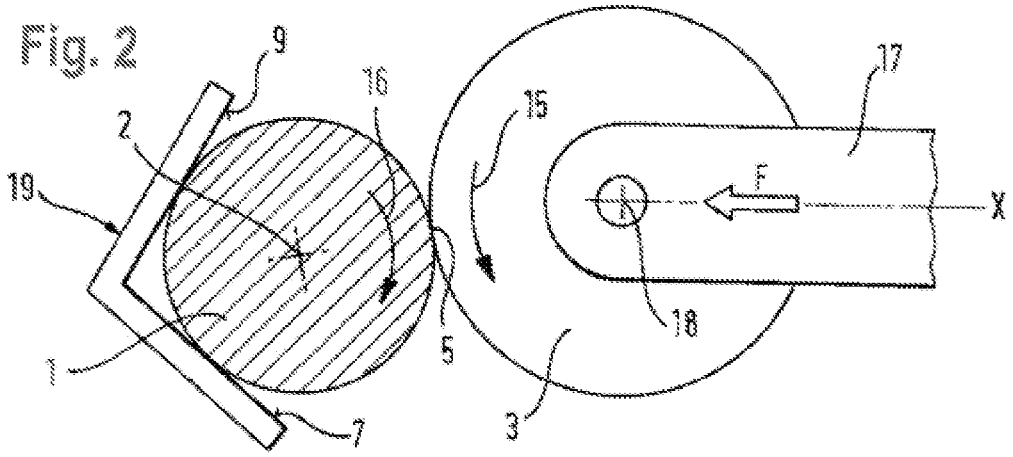
FIG. 2 illustrates an embodiment of the cylindrical grinding machine according to the invention, in which the first and second contact surfaces are combined into a prism.
Figure 3:
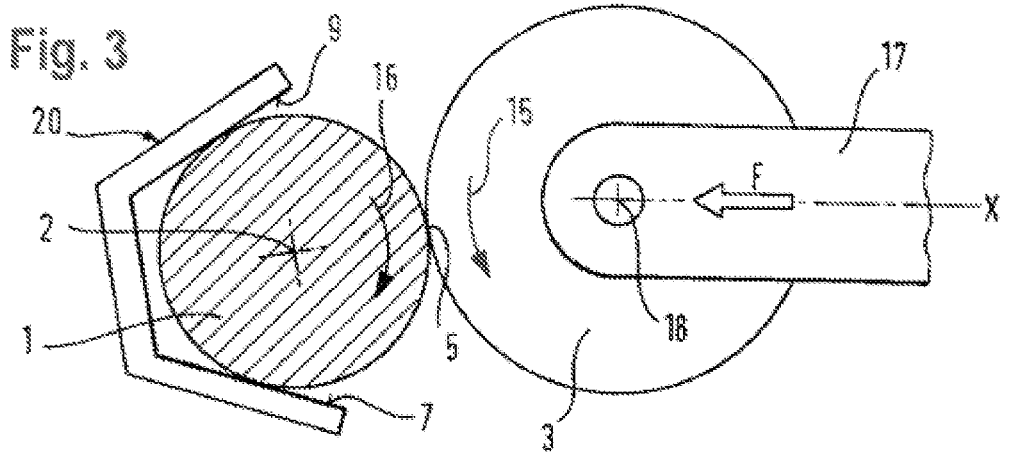
FIG. 3 addresses a modified embodiment of the prism of FIG. 2.
Figure 4:
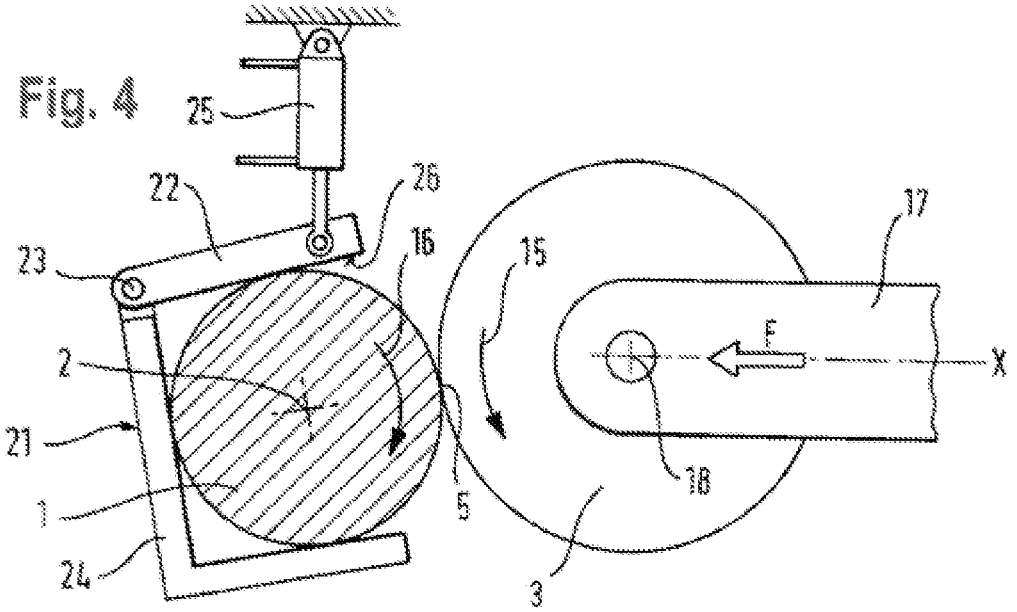
FIG. 4 illustrates an embodiment in which a braking device is integrated into a prism.

In the embodiment according to FIG. 1, the first contact surface 7 and the second contact surface 9 act together similar to a workpiece holder in the form of a prism, which would be familiar to a person skilled in the art. FIGS. 2 to 4 illustrate further embodiments in which the prism is realized in the conventional sense as a structural unit. In FIGS. 2 to 4, the proportions of the grinding disk 3 and the workpiece 1 are changed significantly in comparison to FIG. 1, so that the depiction becomes clearer and also the drawings can be smaller.

As shown in FIG. 2, a grinding spindle unit 17 is provided, which drives the grinding disk 3 to rotate about the rotational axis 18 thereof. The grinding disk 3 contacts the workpiece 1 at the contact point 5. The workpiece 1 is contained by a prism 19, which is formed as a single piece and with the cross-section of an angle. Located on the two arms of the angle are the first contact surface 7 and the second contact surface 9. When the grinding spindle unit 17 is applied in the feed direction X with the application force F in the direction onto the workpiece 1, the result is the rotational driving of the workpiece 1 at the contact point 5 through entrainment, due to the friction. The workpiece 1 is thereby pressed against the first contact surface 7 and the second contact surface 9 of the prism 19, and can only rotate with considerable deceleration in the prism 19. Thus the already-mentioned slippage between the grinding disk 3 and the workpiece 1 at the contact point 5 comes into effect.

FIG. 3 illustrates another form of a prism 20, which here has a trapezoidal cross-section. The workpiece 1 is present only on those two arms of the trapezoid on which the first contact surface 7 and the second contact surface 9 are located. The other units are the same as in FIG. 2. The embodiment comprising the single-piece prism 19 or 20 is simpler than the separated embodiment of the support plate 6 and support rail 8, and thus brings greater stability and accuracy with less effort.

FIG. 4 presents yet another embodiment. Here, the configuration of a prism 21 is present fundamentally corresponding to FIG. 2. However, an upper arm 22 is mounted onto the base 24 of the prism 21 so as to be pivotable about a pivot axis 23. The upper arm 22 can be pressed against the workpiece 1 with an adjustable and controllable action through an actuator 25, which forms part of the brake. The action of the brake 11 has already been described above. The third contact surface 26 is also formed on the upper arm 22.

The invention claimed is:

1. A centerless cylindrical grinding machine, comprising:

a grinding drive unit and a grinding disk that is mounted therein and is driven to rotate by the drive unit, wherein the grinding disk directly applies an application force on a workpiece in a feed direction of the grinding disk, thereby directly and exclusively driving the workpiece to rotate;

a support device that is coupled to the workpiece and arranged to obstruct the rotational movement of the workpiece such that the workpiece is driven to rotate and is ground by the grinding disk responsive to the application force, wherein through the grinding drive unit, the grinding disk can be applied in the radial direction thereof against the workpiece having a rotationally symmetrical contour, and the support device comprises at least one first flat contact surface and one second flat contact surface, which are arranged to form a prism with the first and second contact surfaces forming oblique contact surfaces that are both operationally immobile in the circumferential direction of the workpiece, extend at a distance from one another along the workpiece, and encompass the workpiece under sliding contact in such a manner that the workpiece is held at an optimal position for the grinding process and the application force pushes the workpiece against the first and second flat contact surfaces, with one of the first and second flat contact surfaces disposed on an opposite side of the workpiece from the grinding disk in the feed direction;

a brake arranged on the support device, the brake having a braking body that acts on the workpiece via an adjustment device with an adjustable braking force, wherein the adjustment device is an actuator controlling the clamping force of the braking body acting on the workpiece;

a device for measuring rotational speed configured to constantly monitor the workpiece rotational speed; and an assessment and regulation arrangement configured to constantly maintain an optimal balance between the rotational speed of the grinding disk, the application force applied by the grinding disk, and the braking force applied by the braking body.

2. The cylindrical grinding machine according to claim 1, wherein: the first flat contact surface and the second flat contact surface are arranged so as to be totally operationally immobile.

3. The cylindrical grinding machine according to claim 1, wherein: the first contact surface and the second contact surface are designed so as to be operationally controllably movable.

4. The cylindrical grinding machine according to claim 1, wherein: the first contact surface is located on a support plate that is found beneath the workpiece, and the second contact surface is located on a separate support rail that is arranged opposite the grinding disk.

5. The cylindrical grinding machine according to claim 4, wherein: the braking body forms a further support body having a third contact surface.

6. The cylindrical grinding machine according to claim 5, wherein: the third contact surface faces the first contact surface and acts on the workpiece from above.

7. The cylindrical grinding machine according to claim 1, wherein: the first contact surface and the second contact surface are located on a shared support body, which forms a prism that faces the grinding disk and encompasses the workpiece.

8. The cylindrical grinding machine according to claim 7, wherein: the cross-section of the prism has the form of an angle or a trapezoid.

9. The cylindrical grinding machine according to claim 1, wherein the assessment and regulation arrangement is configured to adjust the braking force applied by the braking body based on the rotational speed of the grinding disk and/or the application force applied by the grinding disk.

10. The cylindrical grinding machine according to claim 1, wherein the assessment and regulation arrangement is configured to adjust the braking force of the braking body while the workpiece is being ground by the grinding disk.

11. The cylindrical grinding machine according to claim 1, wherein the grinding disk presses the workpiece directly toward and against each of the first and second contact surfaces in the grinding process responsive to the application force applied by the grinding disk.

12. The cylindrical grinding machine according to claim 1, wherein the application force presses the workpiece directly toward and against each of the first and second contact surfaces.

13. The cylindrical grinding machine according to claim 1, wherein the second contact surface is arranged between the brake body and the first contact surface.

14. The cylindrical grinding machine according to claim 13, further comprising a spring disposed between the brake body and the actuator.

15. A centerless cylindrical grinding machine, comprising:

a grinding drive unit and a grinding disk that is mounted therein and is driven to rotate by the drive unit, wherein the grinding disk directly applies an application force on a workpiece, thereby directly and exclusively driving the workpiece to rotate;

a support device that is coupled to the workpiece and arranged to obstruct the rotational movement of the workpiece such that the workpiece is driven to rotate and is ground by the grinding disk responsive to the application force, wherein through the grinding drive unit, the grinding disk can be applied in the radial direction thereof against the workpiece having a rotationally symmetrical contour, and the support device comprises at least one first flat contact surface and one second flat contact surface, which are arranged to form a prism with the first and second contact surfaces forming oblique contact surfaces that are both operationally immobile in the circumferential direction of the workpiece, extend at a distance from one another along the workpiece, and encompass the workpiece under sliding contact in such a manner that the workpiece is held at an optimal position for the grinding process and the application force pushes the workpiece against the first and second flat contact surfaces which are stable and consistent;

a brake arranged on the support device, the brake having a braking body that acts on the workpiece via an adjustment device with an adjustable braking force, wherein the adjustment device is an actuator controlling the clamping force of the braking body acting on the workpiece;

a device for measuring rotational speed configured to constantly monitor the workpiece rotational speed; and an assessment and regulation arrangement configured to constantly maintain an optimal balance between the rotational speed of the grinding disk, the application force applied by the grinding disk, and the braking force applied by the braking body, wherein the actuator is configured to rotate the braking body relative to the workpiece to adjust the braking force applied to the workpiece.

16. A centerless cylindrical grinding machine, comprising:

a grinding drive unit and a grinding disk that is mounted therein and is driven to rotate by the drive unit, wherein the grinding disk directly applies an application force on a workpiece, thereby directly and exclusively driving the workpiece to rotate;

a support device that is coupled to the workpiece and arranged to obstruct the rotational movement of the workpiece such that the workpiece is driven to rotate and is ground by the grinding disk responsive to the application force, wherein through the grinding drive unit, the grinding disk can be applied in the radial direction thereof against the workpiece having a rotationally symmetrical contour, and the support device comprises at least one first flat contact surface and one second flat contact surface, which are arranged to form a prism with the first and second contact surfaces forming oblique contact surfaces that are both operationally immobile in the circumferential direction of the workpiece, extend at a distance from one another along the workpiece, and encompass the workpiece under sliding contact in such a manner that the workpiece is held at an optimal position for the grinding process and the application force pushes the workpiece against the first and second flat contact surfaces which are stable and consistent;

a brake arranged on the support device, the brake having a braking body that acts on the workpiece via an adjustment device with an adjustable braking force, wherein the adjustment device is an actuator controlling the clamping force of the braking body acting on the workpiece;

a device for measuring rotational speed configured to constantly monitor the workpiece rotational speed; and an assessment and regulation arrangement configured to constantly maintain an optimal balance between the rotational speed of the grinding disk, the application force applied by the grinding disk, and the braking force applied by the braking body, wherein the braking body is pivotally attached to the support device.

17. A centerless cylindrical grinding machine, comprising:

a grinding drive unit and a grinding disk that is mounted therein and is driven to rotate by the drive unit, wherein the grinding disk directly applies an application force on a workpiece, thereby directly and exclusively driving the workpiece to rotate;

a support device that is coupled to the workpiece and arranged to obstruct the rotational movement of the workpiece such that the workpiece is driven to rotate and is ground by the grinding disk responsive to the application force, wherein through the grinding drive unit, the grinding disk can be applied in the radial direction thereof against the workpiece having a rotationally symmetrical contour, and the support device comprises at least one first flat contact surface and one second flat contact surface, which are arranged to form a prism with the first and second contact surfaces forming oblique contact surfaces that are both operationally immobile in the circumferential direction of the workpiece, extend at a distance from one another along the workpiece, and encompass the workpiece under sliding contact in such a manner that the workpiece is held at an optimal position for the grinding process and the application force pushes the workpiece against the first and second flat contact surfaces which are stable and consistent;

a brake arranged on the support device, the brake having a braking body that acts on the workpiece via an adjustment device with an adjustable braking force, wherein the adjustment device is an actuator controlling the clamping force of the braking body acting on the workpiece;

a device for measuring rotational speed configured to constantly monitor the workpiece rotational speed; and an assessment and regulation arrangement configured to constantly maintain an optimal balance between the rotational speed of the grinding disk, the application force applied by the grinding disk, and the braking force applied by the braking body, wherein the support device includes a base comprising the first flat contact surface and the second flat contact surface, and wherein the brake comprising an upper arm pivotably mounted to the base.

18. A centerless cylindrical grinding machine, comprising:

a grinding drive unit and a grinding disk that is mounted therein and is driven to rotate by the drive unit, wherein the grinding disk directly applies an application force on a workpiece, thereby directly and exclusively driving the workpiece to rotate;

a support device that is coupled to the workpiece and arranged to obstruct the rotational movement of the workpiece such that the workpiece is driven to rotate and is ground by the grinding disk responsive to the application force, wherein through the grinding drive unit, the grinding disk can be applied in the radial direction thereof against the workpiece having a rotationally symmetrical contour, and the support device comprises at least one first flat contact surface and one second flat contact surface, which are arranged to form a prism with the first and second contact surfaces forming oblique contact surfaces that are both operationally immobile in the circumferential direction of the workpiece, extend at a distance from one another along the workpiece, and encompass the workpiece under sliding contact in such a manner that the workpiece is held at an optimal position for the grinding process and the application force pushes the workpiece against the first and second flat contact surfaces, wherein the support device includes a base comprising a first arm including the first flat contact surface and a second arm including the second flat contact surface, and wherein the first arm is substantially perpendicular to the second arm;

a brake arranged on the support device and comprising a braking body including an upper arm pivotably mounted to an end of the first arm of the base, the braking body acts on the workpiece via an adjustment device with an adjustable braking force, wherein the adjustment device is an actuator controlling the clamping force of the braking body acting on the workpiece;

a device for measuring rotational speed configured to constantly monitor the workpiece rotational speed; and an assessment and regulation arrangement configured to constantly maintain an optimal balance between the rotational speed of the grinding disk, the application force applied by the grinding disk, and the braking force applied by the braking body.

19. The cylindrical grinding machine according to claim 18, wherein the actuator is coupled to the upper arm.

20. The cylindrical grinding machine according to claim 1, wherein the device for measuring rotational speed is configured to directly monitor the workpiece rotational speed.

21. The cylindrical grinding machine according to claim 1, wherein the brake includes an elongate body having a contact surface that is configured to be urged against the workpiece.

22. The cylindrical grinding machine according to claim 21, wherein the elongate body has a rectangular cross section.

23. The cylindrical grinding machine according to claim 22, wherein the contact surface engages the workpiece at a first position and wherein the grinding disk directly applies the application force on the workpiece at a second position, the first position being substantially orthogonal to the second position.

* * * * *